US010301109B2

(12) United States Patent
Dervin et al.

(10) Patent No.: US 10,301,109 B2
(45) Date of Patent: May 28, 2019

(54) RECEPTACLE FILLING RAMP

(71) Applicant: VALENCIA PIPE COMPANY, INC., Valencia, CA (US)

(72) Inventors: Andrew Dervin, Valencia, CA (US); Joe Dvoracek, Valencia, CA (US); Kenrick James Durapau, Valencia, CA (US)

(73) Assignee: VALENCIA PIPE COMPANY, INC., Valencia, CA (US)

( * ) Notice: Subject to any disclaimer, the term of this patent is extended or adjusted under 35 U.S.C. 154(b) by 65 days.

(21) Appl. No.: 15/558,559

(22) PCT Filed: Mar. 15, 2016

(86) PCT No.: PCT/US2016/022479

§ 371 (c)(1),
(2) Date: Sep. 14, 2017

(87) PCT Pub. No.: WO2016/149275

PCT Pub. Date: Sep. 22, 2016

(65) Prior Publication Data

US 2018/0057258 A1 Mar. 1, 2018

Related U.S. Application Data

(60) Provisional application No. 62/133,917, filed on Mar. 16, 2015.

(51) Int. Cl.

| | |
|---|---|
| ***B08B 1/00*** | (2006.01) |
| ***A47L 13/52*** | (2006.01) |
| ***B65F 1/10*** | (2006.01) |
| *E01H 1/12* | (2006.01) |

(52) U.S. Cl.

CPC ..... *B65F 1/10* (2013.01); *A47L 13/52* (2013.01); *B08B 1/00* (2013.01); *B65F 2210/148* (2013.01); *E01H 1/12* (2013.01)

(58) Field of Classification Search

CPC ... B65F 1/10; B65F 1/00; A47L 13/52; B08B 1/00; E01H 1/12

See application file for complete search history.

(56) References Cited

U.S. PATENT DOCUMENTS

| | | | |
|---|---|---|---|
| 4,312,531 | A | 1/1982 | Cross |
| 4,802,258 | A | 2/1989 | Jensen |
| 4,907,714 | A | 3/1990 | Gatz |

(Continued)

OTHER PUBLICATIONS

International Search Report for PCT/US2016/022479, dated Aug. 15, 2016.

(Continued)

*Primary Examiner* — Jason K Niesz
(74) *Attorney, Agent, or Firm* — Ladas & Parry, LLP

(57) ABSTRACT

A filling ramp for attachment to and filling of a receptacle is described. The filling ramp includes: an attachment end for attachment to a receptacle, the attachment end including connectors configured to interface with the rim of the receptacle; a sheet extending from the attachment end at a proximal end to terminate at a distal end and forming a slide between the distal and proximal ends, the distal end forming a substantially linear edge having a thickness that facilitates movement of material from a surface in contact with the distal end onto the filling ramp.

18 Claims, 13 Drawing Sheets

(56) References Cited

U.S. PATENT DOCUMENTS

| | | | | |
|---|---|---|---|---|
| 5,088,214 | A | 2/1992 | Jones | |
| D358,915 | S | 5/1995 | O'Donoghue | |
| D439,718 | S | 3/2001 | Thorpe | |
| D445,550 | S | 7/2001 | Wigren et al. | |
| 6,708,742 | B2 | 3/2004 | Weathers et al. | |
| D533,701 | S | 12/2006 | Payton | |
| D651,780 | S | 1/2012 | Grasteit | |
| 8,152,019 | B1 | 4/2012 | Miller | |
| 8,291,543 | B2 * | 10/2012 | McCoy ..... | A47J 47/18 15/257.1 |
| 8,757,453 | B1 | 6/2014 | Olsson | |
| D729,483 | S | 5/2015 | Kent | |
| 9,212,000 | B1 | 12/2015 | McDonough | |
| D802,865 | S | 11/2017 | Derwin | |
| 2004/0221872 | A1 | 11/2004 | Perelli et al. | |
| 2005/0056649 | A1 | 3/2005 | Simonson | |

OTHER PUBLICATIONS

Written Opinion of the International Search Authority for PCT/US2016/022479, dated Aug. 15, 2016.

PCT International Preliminary Report on Patentability (Chapter I) from PCT/US2016/022479 dated Sep. 19, 2017.

PCT International Search Report and Written Opinion from PCT/US2016/022479 dated Aug. 15, 2016 (11 pages) with PCT Notice dated Aug. 16, 2016 (1 page).

PCT International Search Report and Written Opinion from PCT/US2016/022479 dated Jun. 10, 2016 (11 pages).

From U.S. Appl. No. 29/557,101 (now U.S. Design Pat. No. D802865), Notice of Allowance dated Jul. 31, 2017.

From U.S. Appl. No. 29/557,101 (now U.S. Design Pat. No. D802865), Office Action dated Apr. 11, 2017.

* cited by examiner

RECEPTACLE FILLING RAMP

CROSS-REFERENCE TO RELATED APPLICATIONS

This application is the U.S. national phase of PCT Application No. PCT/US2016/022479 filed on Mar. 15, 2016, which claims priority to and the benefit of U.S. Provisional Application No. 62/133,917 filed on Mar. 16, 2015, the disclosures of which are incorporated herein by reference in their entireties.

TECHNICAL FIELD

This disclosure relates devices for filling receptacles including trash receptacles such as trash cans, buckets, totes, pails and the like.

BACKGROUND

The present disclosure relates to devices to aid in filling receptacles such as trash receptacles. Frequently, when material is removed from a surface, such as the floor, the ground, a table, a work bench and the like, the material is pushed into a scoop or a pan, and then transferred from the scoop or pan to a receptacle. A common example is where trash is swept from the floor into a dustpan, and then dumped from the dustpan into a garbage can.

Other common situations where material is removed from a surface to be placed into a receptacle include, but are not limited to the clearing or cleaning of yard waste, workshop scrap, floor sweepings, workbenches, tables, patios, offices, floors, etc.

The use of a separate dust pan requires multiple steps and is in some ways less desirable than transferring the material directly from the surface to the receptacle. However, trash receptacles generally are not well suited to such direct transfers because of the elevational difference between the surface and the interior of the receptacle and because of the poor conformance of the edge of the receptacle to the surface (e.g. round receptacle to flat surface.)

SUMMARY

In a first embodiment disclosed herein is a filling ramp for attachment to and filling of a receptacle, the filling ramp comprising: an attachment end for attachment to a receptacle, the attachment end comprising connectors configured to interface with the rim of the receptacle; a sheet extending from the attachment end at a proximal end to terminate at a distal end and forming a slide between the distal and proximal ends, the distal end forming a substantially linear edge having a thickness that facilitates movement of material from a surface in contact with the distal end onto the filling ramp, wherein a portion of the filling ramp is configured to extend into the opening of the receptacle a first distance when attached to the receptacle, the distal end is located a second distance away from an outer wall of the receptacle in a direction normal to the wall of the receptacle that is greater the first distance.

In a first aspect of the first embodiment, the filling ramp can be a part of a receptacle system where the filling ramp is connected to a rim at an opening of the receptacle with the sheet extending upward and radially outward from the rim of the receptacle and one of the one or more handles of the receptacle is located on the outer wall directly below the filling ramp, and the distance the distal end is located away from the outer wall of the receptacle is greater than a length 43 that the one handle extends normal to the outer wall.

In a second aspect of the first embodiment, the filling ramp can be a part of a receptacle system where the filling ramp is connected to a rim at an opening of the receptacle with the sheet extending upward and radially outward from the rim of the receptacle and one of the one or more handles of the receptacle is located on the outer wall directly below the filling ramp, and the distance the distal end is located away from the outer wall of the receptacle is greater than a length that the one handle extends normal to the outer wall, and when the receptacle system is located on a surface and positioned on the receptacle system's side, the bottom and the distal end are in contact with the surface while the one handle is located between the surface and the outer wall of the receptacle.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
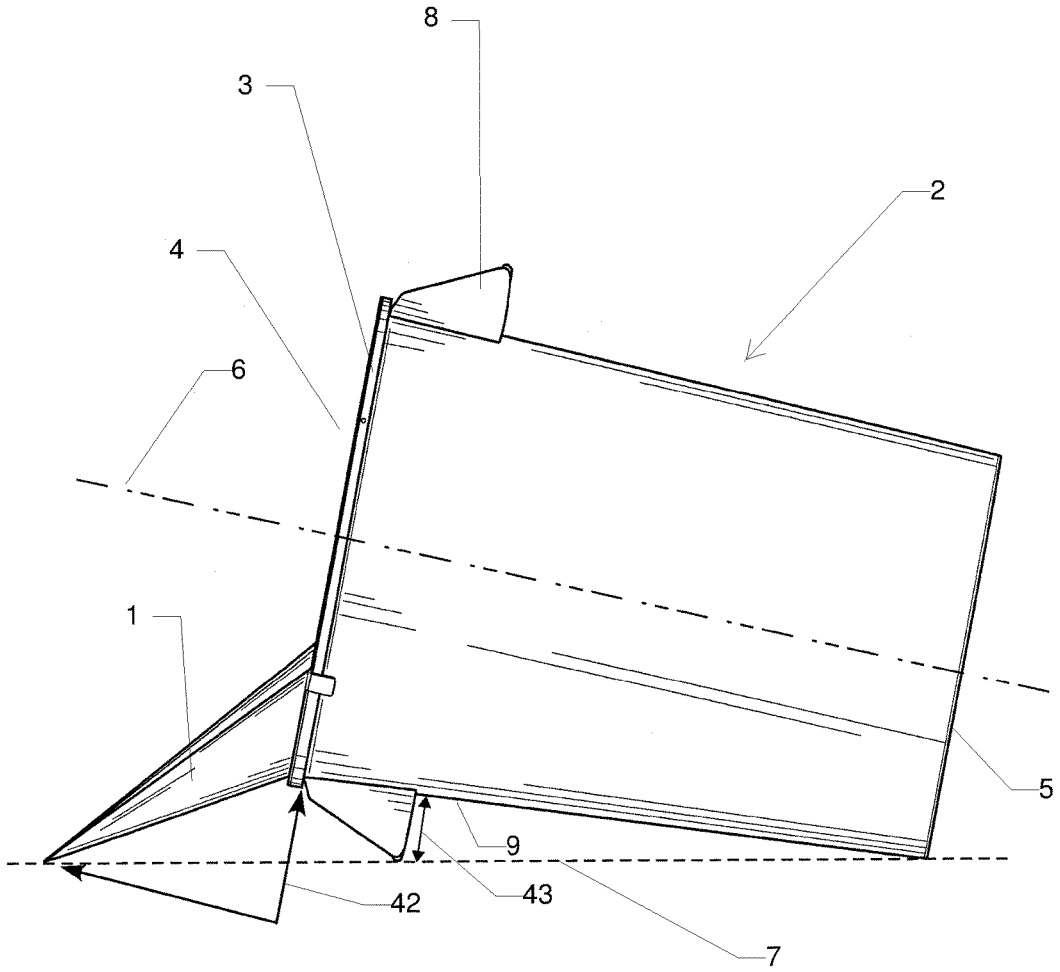
FIG. 1 shows a side view of a filling ramp attached to trash receptacle in a position for filling.

FIG. 1 shows an embodiment of a filling ramp 1 attached to a trash receptacle 2. The filling ramp 1 is attached to the rim 3 of the trash receptacle 2 adjacent the opening 4 of the trash receptacle. As can be seen in FIG. 1, the trash receptacle 2 can be angled upward such that the opening 4 is displaced vertically in relation to the bottom 5, with a central axis 6 of the trash receptacle being inclined from the horizontal. In this position, the filling ramp 1 extends outward from receptacle 2 and is angled downward toward the surface 7 upon which the trash receptacle 2 is positioned, and in some embodiments the end of the filling ramp 1 can contact the surface 7.

Figure 2:
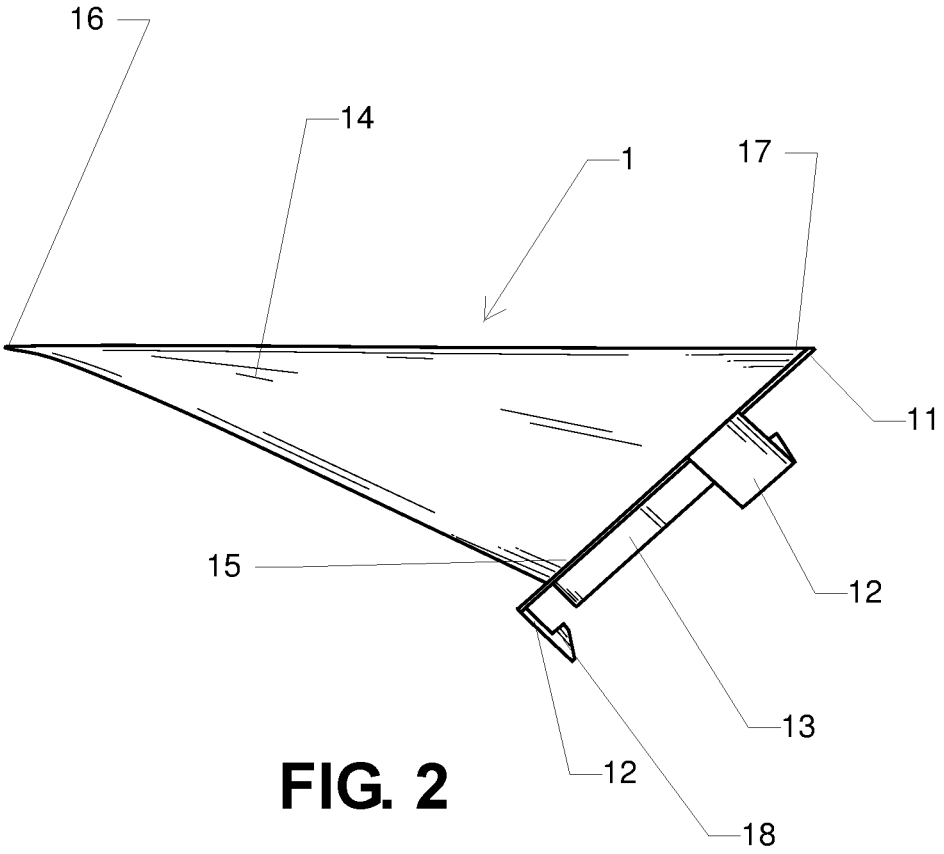
FIG. 2 shows a side view of a filling ramp.

FIG. 2 shows features of the filling ramp 1 where an attachment end 17 comprising an optional attachment flange 11 is connected to a sheet forming a slide 14 at a proximal end 15 of the sheet. Extending from the attachment flange 11 are connectors 12 and an optional skirt 13. As can be seen in FIG. 2, a skirt 13, when present can be discontinuous, meaning a series of skirt portions interrupted by gaps or spaces along the direction of the skirt. The sheet 14 extends outward and away from the attachment flange 11 at an angle ending at a distal end 16. In some embodiments, the filling ramp 2 can be sized and dimensioned such that the length and angling of the sheet 14 in relation to attachment flange 11 or to the receptacle 2 will allow the distal end 16 of the filling ramp 1 to contact the surface 7 while the bottom 5 of the receptacle is also contacting the surface 7 and a handle 8 or other protuberance extending from the side of receptacle 2 is in contact with the surface 7. In some embodiments, the filling ramp 1 is sufficiently stiff such that the angling of the sheet 14 in relation to attachment flange 11 or to receptacle 2 can be maintained with the distal end 16 and the bottom 5 of the receptacle in contact with the surface 7, without a handle 5 or other protuberance from the receptacle 2 supporting the opening 4 of the receptacle 2. Accordingly, filling ramp 1 having sheet 14 angled downward can provide greater flexibility in attachment location for the filling ramp 1 to the receptacle 2 than a design where sheet 14 is not angled downward as handles or other protuberances from receptacle will not cause the distal end 16 of the filling ramp 1 to be moved a significant distance away from the surface 7. In some embodiments, the downward angling of sheet 14 can result in a clearance space under the opening 4 of receptacle 2, such as between rim 3 and surface 7, of more than 2.5 cm, more than 5 cm, more than 7.5 cm, more than 10 cm, more than 12.5 cm, more than 15 cm, more than 17.5 cm, more than 20 cm or between 1.3 cm and 2.5 cm, between 2.5 cm and 5 cm, between 5 cm and 7.5 cm, between 7.5 cm and 10 cm, between 10 cm and 12.5 cm, between 12.5 cm and 15 cm, between 15 cm and 17.5 cm or between 17.5 cm and 20 cm. In some embodiments, the angling of sheet 14 is sufficient to provide clearance between the external edge of the attachment flange 11 and surface 7, when the distal end 16 is in contact with horizontal surface 7 and attachment flange 11 is in a vertical orientation, with the clearance being more than 2.5 cm, more than 5 cm, more than 7.5 cm, more than 10 cm, more than 12.5 cm, more than 15 cm, more than 17.5 cm, more than 20 cm or between 1.3 cm and 2.5 cm, between 2.5 cm and 5 cm, between 5 cm and 7.5 cm, between 7.5 cm and 10 cm, between 10 cm and 12.5 cm, between 12.5 cm and 15 cm, between 15 cm and 17.5 cm or between 17.5 cm and 20 cm.

The angling of sheet or slide 14 can also be described as locating the distal end 14 of the filling ramp when the filling ramp 1 is attached to a receptacle 2 a distance 42 from the outer wall 9 of the receptacle 2, as measured in a direction normal to the outer wall 9 of the receptacle 2. In some embodiments, the distance 42 can be equal to the length of the skirt 13 or the distance a portion of the filling ramp 1 is inserted into the opening 4 of the receptacle 2. In some embodiments, the distance can be greater than the length of the skirt 13 or the distance of insertion. In some embodiments, the distance can be a multiple of 2 or 3 or 4 or 5 of the length of the skirt 13 or the distance of insertion. In some embodiments, the distance 42 can be a fraction of the length of the skirt 13 or the distance of insertion, such as one half, one third, one quarter, or one fifth.

Figure 3:
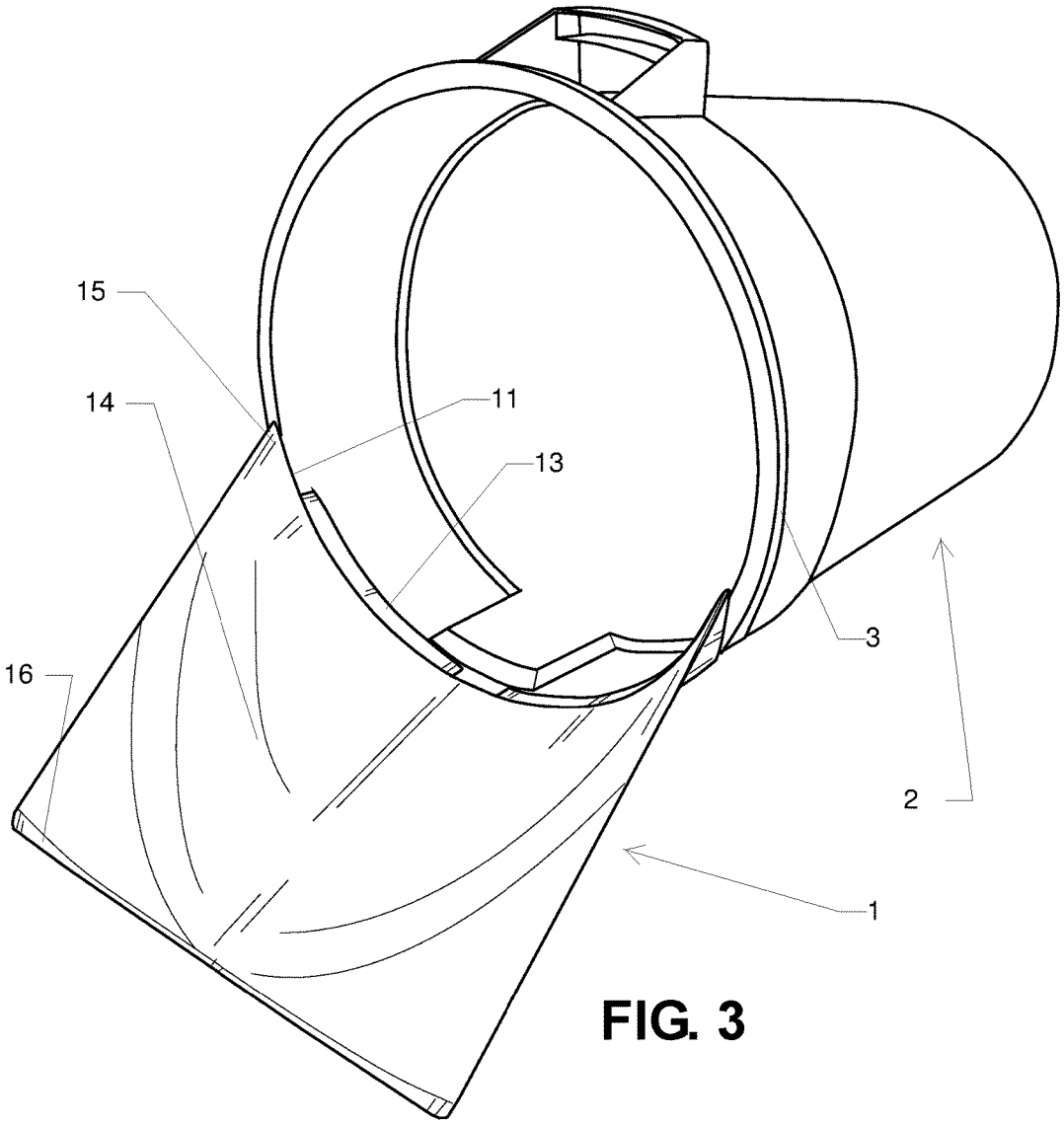
FIG. 3 shows a perspective view of a filling ramp attached to a trash receptacle.
Figure 4:
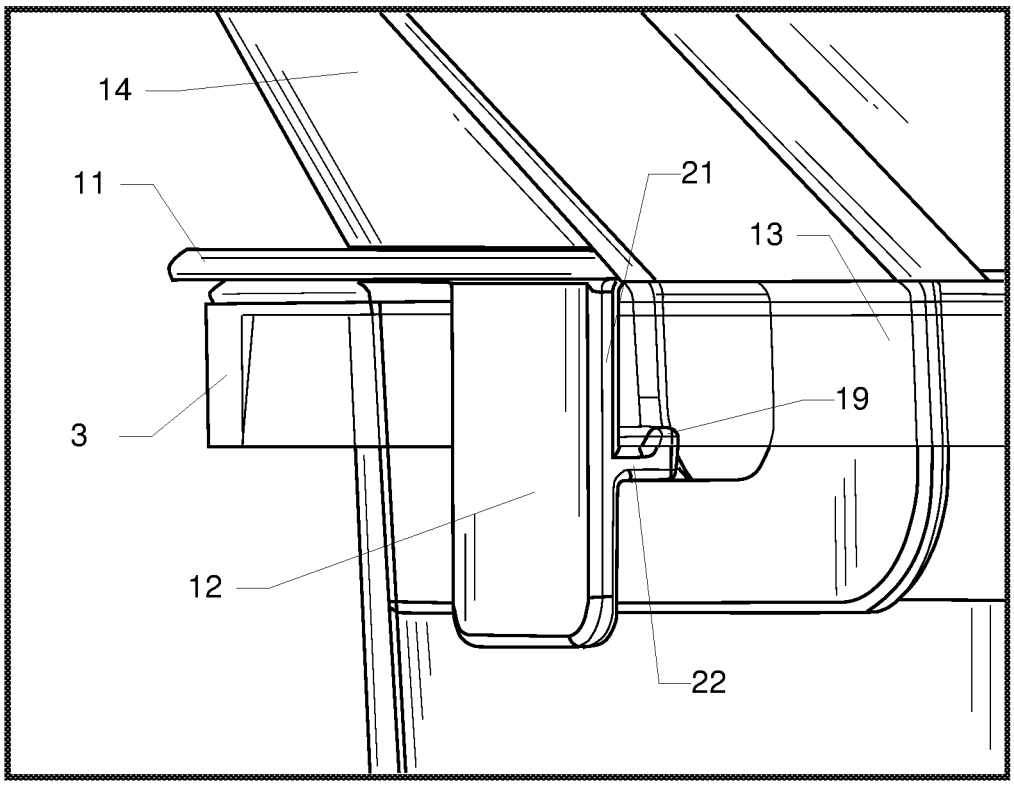
FIG. 4 shows one embodiment of a connector on a filling ramp.

As can be seen in FIGS. 3 and 4, a connector 12 for connecting the filling ramp 1 to a receptacle 2 can have the form of an elongate structure 21 extending down from the attachment flange 11 with a lateral extension 22 which engages the bottom edge of a rim 3 of the receptacle 2 with an optional retainer 19 extending around to an inner surface of rim 3. Optional retainer 19 can in some situations provide a more secure connection to receptacle 2. In various embodiments, the lateral extension 22 can have the shape of a rectangular prism 28, a pin 31, a rounded bump 29, or other suitable shape which is able to extend under the bottom edge of the rim 3 and restrict the upward movement of the filling ramp 1 in relation to the receptacle 2. In some embodiments, the elongate structure 21 and lateral extension 22 can be configured to be bent away from the rim 3 to facilitate removal of the filling ramp 1 from the receptacle 2.

Various embodiments of filling ramp 1 can have different numbers of connectors. For example, in some cases there can be a single connector 12 which extends over a portion of the rim 3 of the receptacle 2. In some cases, there can be two, three, four or more connectors 12 extending from the attachment flange 11. Connectors 12 can be spaced at regular intervals or irregular intervals.

In some embodiments, connectors 12 can work in conjunction with a skirt 13 to grasp or pinch a portion of the receptacle 2, such as by pinching the rim 3 of the receptacle 2 between skirt 13 and one or more connectors 12.

The skirt 13, when present, can extend a distance into the receptacle 2, such as to cover the interface or gap between attachment flange 11 and the rim 3 of the receptacle 2. The distance that the skirt 13 extends into the receptacle 2 is the length of the skirt 13. Such a covering can, for example prevent materials such as trash or debris from passing through the interface and falling back to surface 7. In some embodiments, skirt 13 can extend further into receptacle 2, such as 10%, 20%, 30%, 40%, 50%, 60%, 70%, 80%, 90% or 100% of the distance to the bottom 5 of receptacle 2. However, it is noted that greater extension of the skirt 13 into the receptacle 2 will require greater quantities of material to make a filling ramp 1 and can result in difficulties for storing filling ramp 1 when not attached to a receptacle 2. In addition, longer skirts can result in shifting, tearing or other disturbance of a liner or bag present in receptacle 2, such as when the filling ramp is removed. In addition, longer skirts can make it difficult to attach a filling ramp 1 to a partially filled receptacle 2 with or without a liner bag due for example to the filling material blocking the downward movement of the skirt within the receptacle 2. In some embodiments, the length of one or more skirts 13 can be sized relative to the length of connector 12, for example the length of the skirt 13 can be approximately the length of connector 12, or it can be longer or shorter than the length of connector 12. In some embodiments, skirt 13 can be approximately 20%, 40%, 50%, 60%, 80%, 120% or 150% of the length of skirt 13. In some embodiments where there are two or more skirts, one skirt 13 can be approximately the same size or longer or shorter than another skirt 13. In some embodiments, one skirt 13 can be approximately 20%, 40%, 50%, 60%, 80%, 120% or 150% of the length of another skirt 13.

In addition, the skirt can assist in supporting the opening 4 of the receptacle 2 when the distal end 16 and the bottom 5 of the receptacle 2 are on a surface 7. As the amount of elevation of the opening 5 changes due to changes in the angulation of the filling ramp, the skirt can be required to supply different amounts and/or directions of force to the receptacle, with different lengths of skirt being more favorable.

Figure 9:
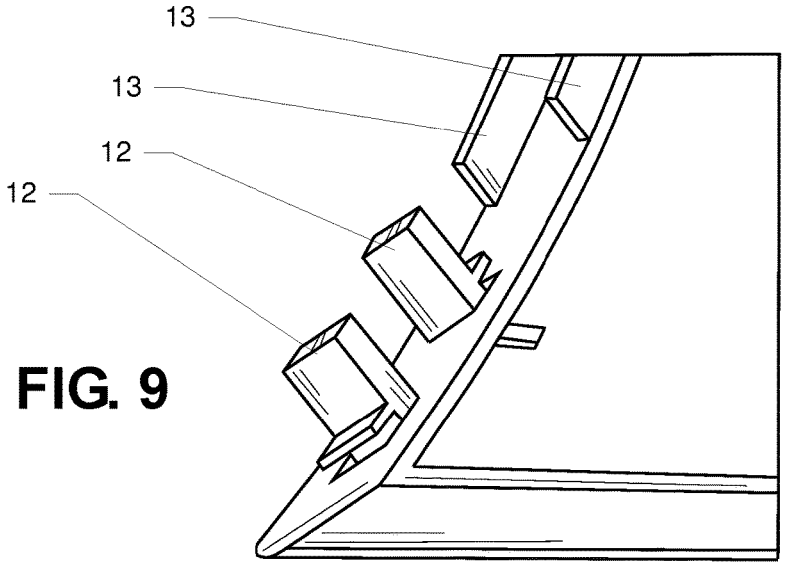
FIG. 9 shows an embodiment of a filling ramp which utilizes two skirts.

In some embodiments, such as that shown in FIG. 9, skirts 13 can be positioned to contact both the interior and exterior of the receptacle 2 at the rim 3.

Connectors 12 can have a number of different designs. In some embodiments, an elongate structure 21 can extend from the attachment flange 11 and a lateral extension 22 protrudes from the elongate structure 21 and is configured to interface with an underside portion of the rim 3 of the receptacle 2, or another portion of receptacle 2 such as an opening or a hole, so as to hold the filling ramp 1 engaged to receptacle 2. The lateral extension 22 can be located at the end of elongate structure 21 or the lateral extension 22 can be located at a position along the length of elongate structure 21, for example in the middle. In some embodiments, a which portion 18 can be located along the elongate structure 21 and under lateral extension 22, as shown in FIG. 2. In some embodiments, the connector 12 can resemble a hook or a square hook or a draw bolt which interacts with an underside portion of rim 3 or another portion of receptacle 2. In some embodiments, the lateral extension 22 can be triangular or wedge shaped, such as is shown in FIG. 2. In some situations, a triangular or wedge shaped lateral extension can facilitate connecting the filling ramp 1 to receptacle 2, such as by the angular shape of the lateral extension easing the elongate structure 21 outward over the rim 3 of receptacle 2 as the filling ramp 1 is pushed down.

Figure 8A:
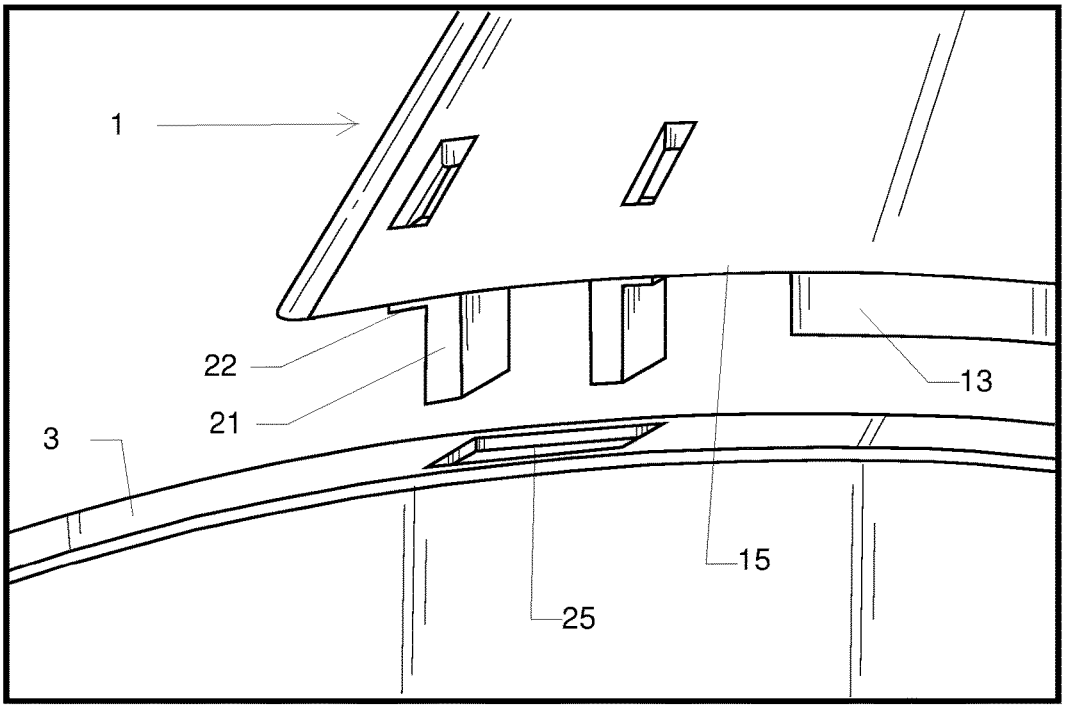
FIGS. 8A and 8B show another embodiment of a connector.
Figure 8B:
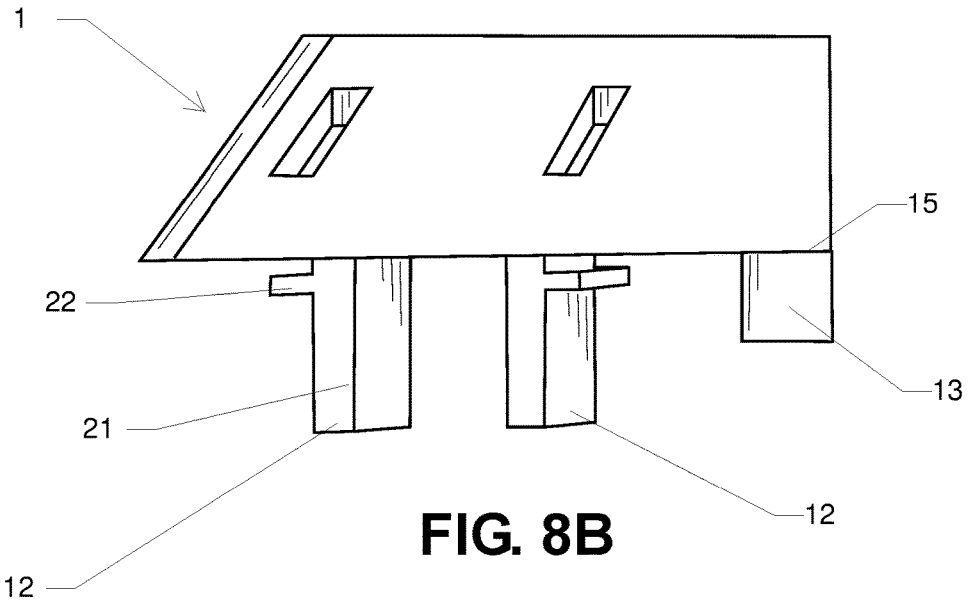

An alternate design for an elongate structure 21 with lateral extension is shown in FIGS. 8A and 8B where an elongate structure 21 and lateral extension 22 are positioned so that the lateral extension 22 extends from the elongate structure 21 in a direction along the attachment end 17, rather than with the lateral extension 22 extending from the elongate structure 21 in a direction toward the interior or away from the interior of the receptacle 2 as in FIG. 4. In some embodiments, the connector 12 with elongate structure 21 and lateral extension 22 directed along the attachment end 17 can be arranged in pairs, wherein each of the pair of connectors has the lateral extensions 22 pointed away from another as in FIGS. 8A, 8B and 9. These pairs of connectors are then configured to interface with a slot 25 in the rim 3 of the receptacle 2 wherein both connectors 12 of a pair are received into the same slot and the lateral extensions 22 hook over the edge of the slot 25 to prevent accidental or inadvertent separation of filling ramp formed from receptacle 2. In some embodiments, the elongate structure 21 is configured to provide an area for the connector 12 to be squeezed for removal of the filling ramp 1 from receptacle 2.

Figure 5:
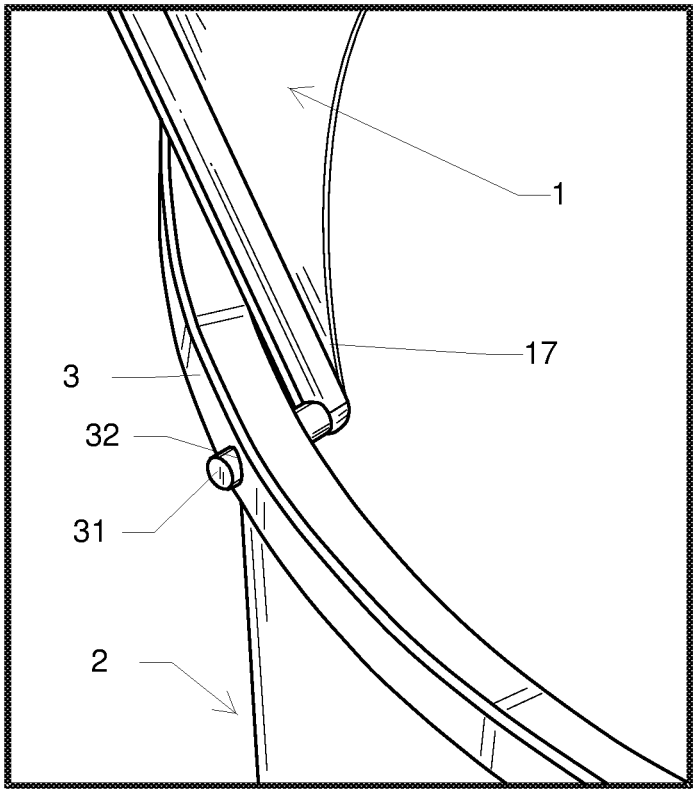
FIG. 5 shows a connector utilizing a pin.

In some embodiments, connector 12 can utilize pins 31 extending from attachment end 17 or attachment flange 11. FIG. 5 shows pin 31 extending from attachment end 17 through receiver hole 32 in the rim 3 of receptacle 2. A similar arrangement can be utilized on the opposite side of filling ramp 1. With the embodiment shown in FIG. 5, the proximal end of the filling ramp 1 when attached to the receptacle 2 is present within the receptacle 2 a distance related to the degree of angulation of the filling ramp desired.

Figure 6A:
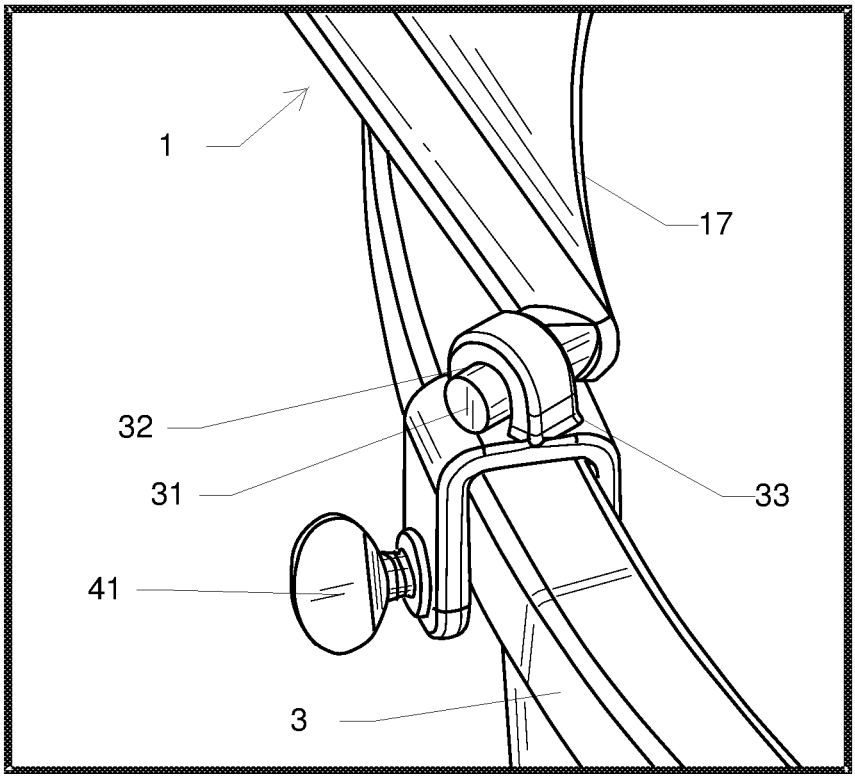
FIGS. 6A and 6B shows a two-part connector having a pin.
Figure 6B:
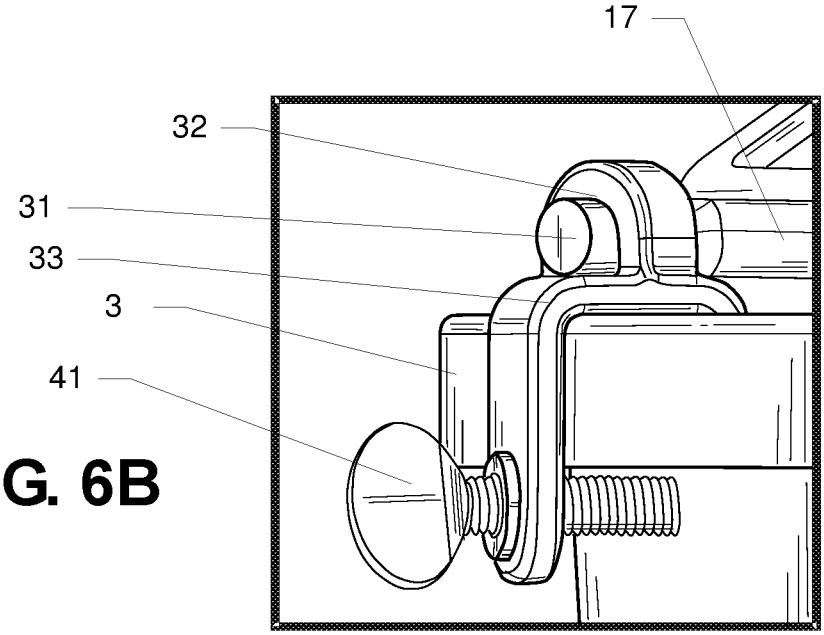

In some embodiments such as those shown in FIGS. 6A and 6B, connector 12 can comprise a two-part structure of, for example a first part comprising a pin 31 extending from attachment end 17 or attachment flange 11 is joined with a connector base 33 comprising a receiver hole 32. The pin 31 extends into or through receiver hole 32. The connector base 33 is in turn affixed to the receptacle 2 at an appropriate location, such as the rim 3. The connector base 33 can be affixed by any suitable method, including but not limited to gluing, cementing, welding or through the use of fasteners 41, such as screws, bolts, rivets, thumbscrews, nuts, wing nuts, draw bolt and the like. When fasteners are used, the fastener can interface connected late with the rim 3 of the receptacle 2, a portion of the wall of the receptacle 2 below the rim 3 or with the underside or backside of the rim 3.

Figure 7A:
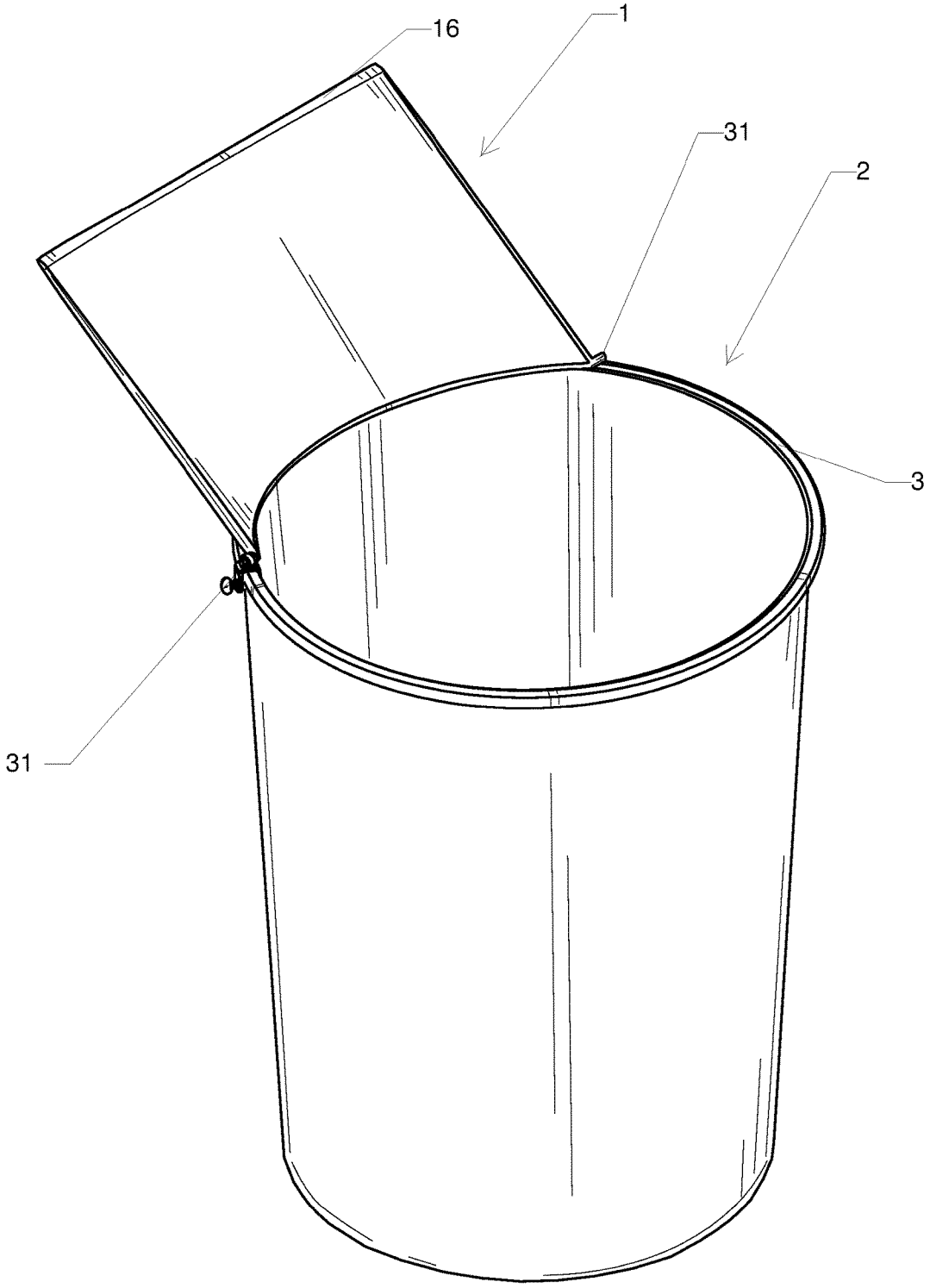
FIGS. 7A and 7B show different positions of a hinged filling ramp.
Figure 7B:
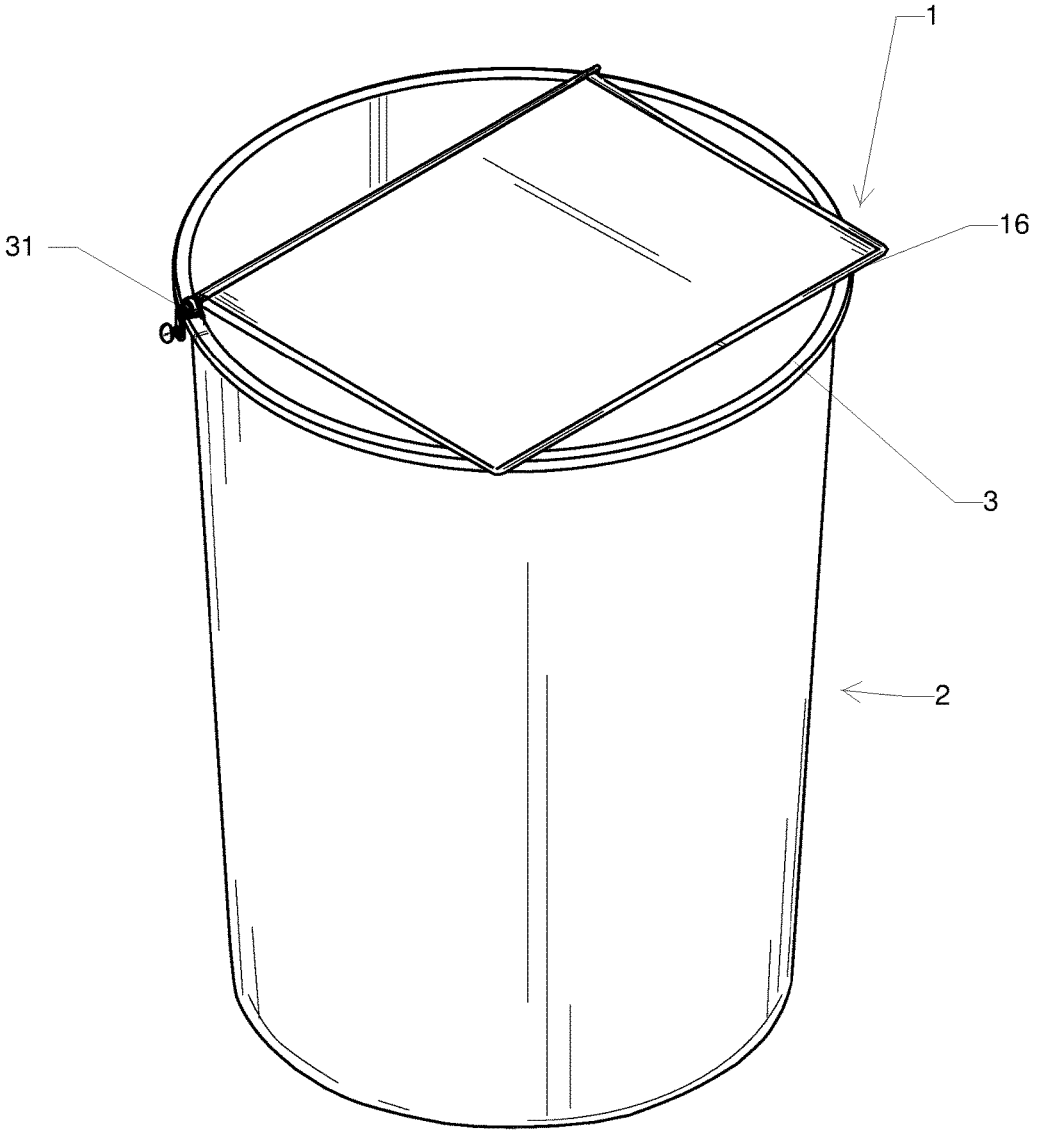

In some embodiments, the connector can provide a hinge function, such as by the use of pins 31 extending horizontally when viewed in place on an upright receptacle 2. The pins 31 provide a pivot point allowing the filling ramp 12 pivot between a raised position, as shown in FIG. 7A, and a lowered position as shown in FIG. 7B. In some embodiments, the filling ramp 1 can be sized and dimensioned such that in the lowered position, a portion of the filling ramp 1 will contact the rim 3 of the receptacle 2 and be in a substantially horizontal position. In some embodiments, the filling ramp 1 can be sized and dimensioned such that the filling ramp 1 will not contact the rim 3 of the receptacle when in the lowered position, but instead will rest upon material present within the receptacle 2 or hang in a substantially vertical position within the receptacle 2.

In some embodiments utilizing pins 31, such as those shown in FIGS. 6A, 6B, 7A and 7B, the angle of the filling ramp can be determined by the location of the pins 31 on the attachment end 17 or attachment flange 11 and the location of receiver holes 32 in relation to the rim 3 of the receptacle 2. In the raised position, as in FIG. 7A, the angle can be determined by where in the arc of positions, the sheet or slide 14 contacts the rim 3 of the receptacle 2.

Figure 10:
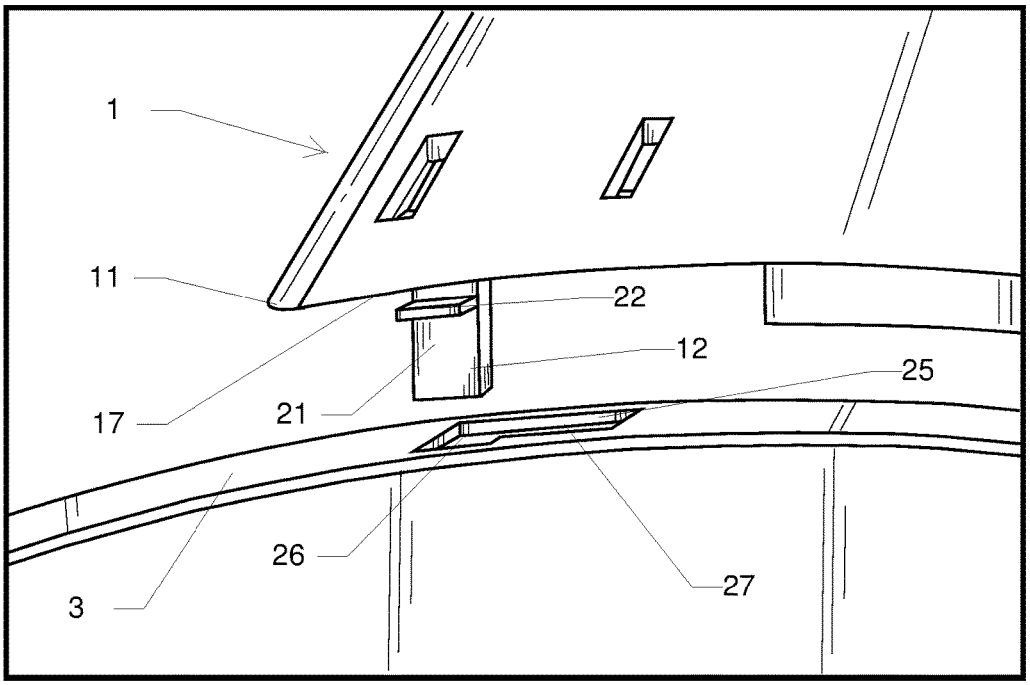
FIG. 10 shows a twist lock embodiment of a connector.

In some embodiments, connectors 12 can include a twist lock design. With a twist lock design, elongate structure 21 extends from attachment end 17 or attachment flange 11, and elongate structure 21 includes a lateral extension 22 or a thickened portion, of an appropriate shape, such as a block, a bump, etc., or a slot. The elongate structure 21 is configured to lockingly interact with a slot 25 on the top of the rim 3 of the receptacle 2. In some embodiments of a twist lock design, such as that shown in FIG. 10, slot 25 can include a wide portion 26 where the elongate structure 21 is initially inserted, and a narrower portion 27 extending along the top of the rim 3. With this embodiment, after inserting the elongate structure 21 into the corresponding slot 25, the filling ramp 1 is slid or twisted along the top of the rim 3 of the receptacle 2 into a lock position such that the elongate structure 21 is located in the narrow portion 27 of the slot and the thickened portion or lateral extension 22 of the elongate structure 21 is below the surface of the rim 3 of the receptacle and the thickened portion restricts the elongate structure 21 from being pulled out of the corresponding slot 25. Alternatively, a slot (not shown) on the elongate structure 21 can engage the rim 3 at the narrow portion of the slot when the filling ramp 1 is twisted.

Figure 11:
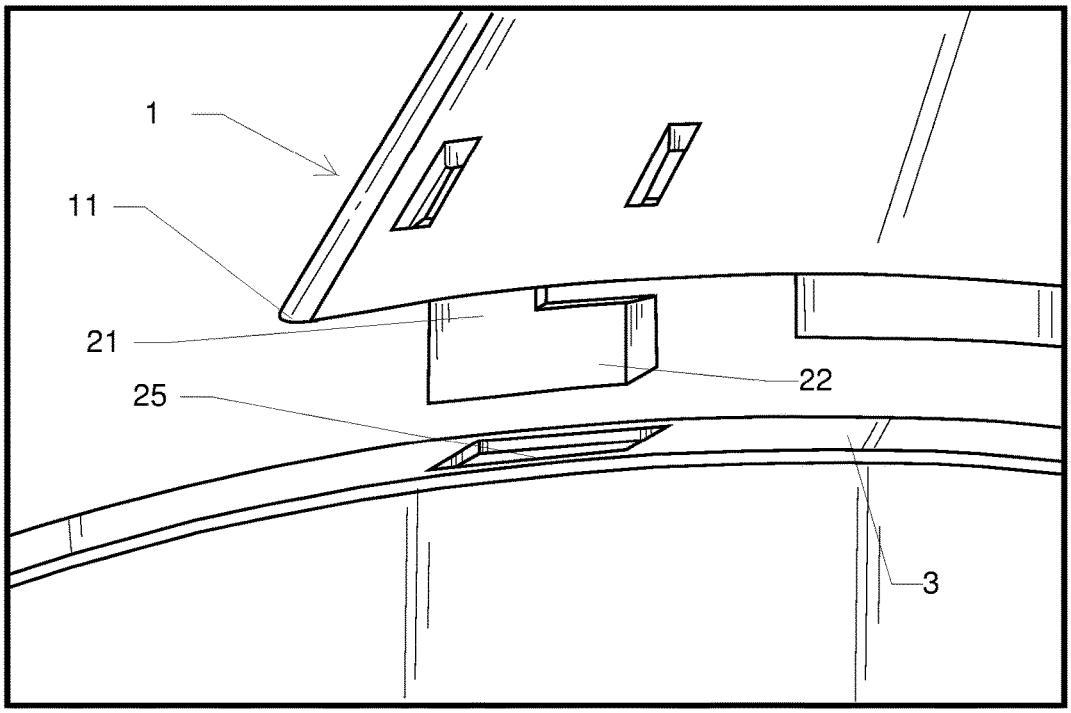
FIG. 11 shows a twist lock embodiment of a connector.
Figure 12A:
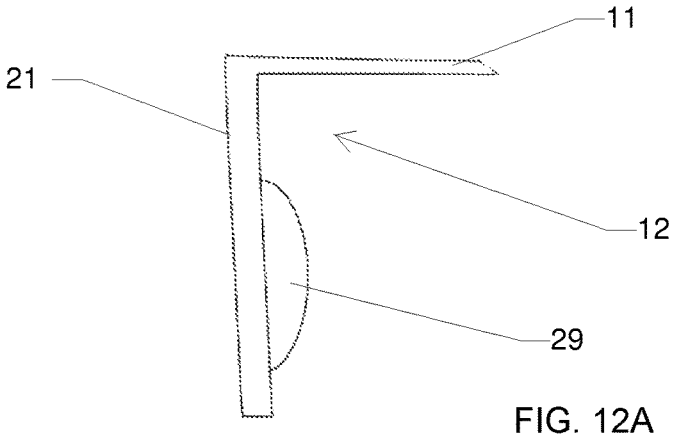
FIGS. 12A-D show different embodiments of a connector.
Figure 12B:
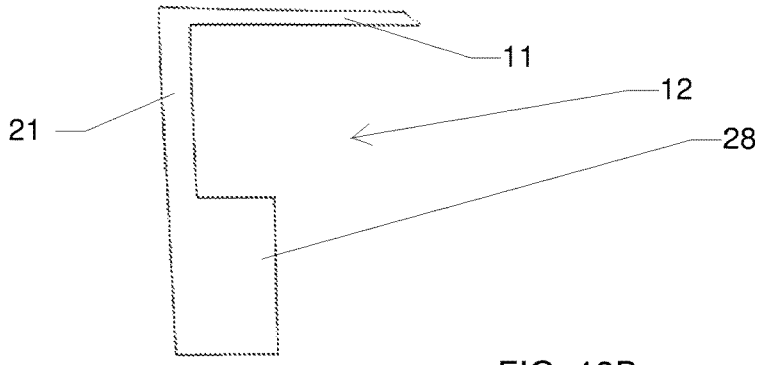
Figure 12C:
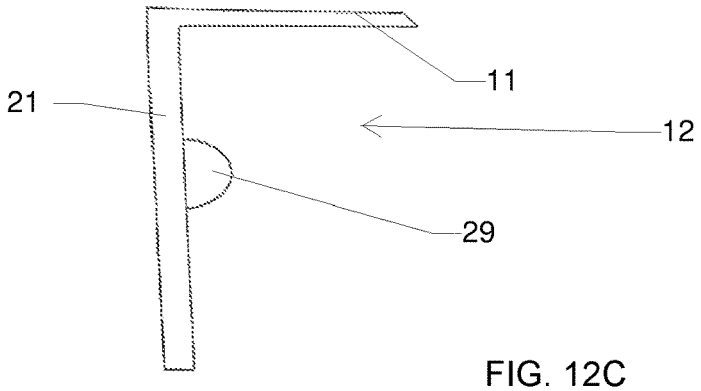
Figure 12D:
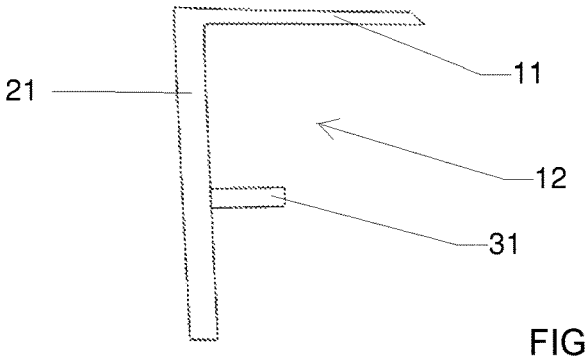

In some embodiments of a twist lock design, such as those shown in FIG. 11, corresponding slot 25 can have a substantially constant width. With this embodiment, after inserting the elongate structure 21 into the corresponding slot 25, the filling ramp 1 is slid (or twisted) along the top of the rim 3 of the receptacle 2 into a lock position such that the lateral extension 22 or thickened portion is present under the rim 3 at an end of the slot 25.

In some embodiments, the connector 12 can be a two-part connector, wherein the slots or lips or rims or other features described herein as present on the receptacle 2 or rim 3 of the receptacle 2 are present on a connector base 33 which includes the appropriate slots or lips or rims or other features and is attachable to the receptacle 2 by appropriate methods. The connector base 33 can be permanently attached or non-permanently attached. Attachment methods can include gluing, cementing, welding, and attachment with fasteners such as screws, nuts, bolts, studs, rivets, Velcro, threading, etc. The use of a connector base 33 can be applied to any of the connectors described herein.

In some embodiments, the features which connect the filling ramp to the receptacle 2 can have their location reversed between the receptacle 2 (or rim 3 of receptacle 2)

and the filling ramp 1 (or the attachment end 17 or attachment flange 11 of filling ramp 1). More specifically, the location of the features of the connectors 12 described herein as being present on the filling ramp 1 can be present on the receptacle 2 or on the rim 3 of the receptacle 2, and the features described herein as being present on the receptacle 2 or on the rim 3 of the receptacle 2 which interact with the connector 12 can be present on the filling ramp 1. In some embodiments, this reversal of the location of features can also be accompanied by the use of a connector base 33 which includes features to be added to the receptacle 2, where the connector base 33 is attached to the receptacle 2 such as at the top of the rim 3 of the receptacle 2. In some embodiments, the connector base 33 can be discrete elements attached along the top of the receptacle 2. In some embodiments, the connector base 33 can be a single piece that extends over a portion of the top of the receptacle 3. In some embodiments, the connector base 33 extends along a portion of the top of the receptacle 3 which corresponds to the attachment end 17 or attachment flange 11 of filling ramp 1. In some embodiments, the connector base 33 extends along a greater portion of the top of the receptacle 3 then what corresponds to the attachment end 17 or the attachment flange 11 of filling ramp 1. In some embodiments, the connector base extends along the entire top of the receptacle 2.

In some embodiments, the filling ramp 1 can be attached to the receptacle 2 in a circumferential location corresponding to where a handle 8 or other protuberance of the receptacle 2 is. In some such embodiments, the position of the handle 8 will cause the opening of the receptacle 2 to be raised up in relation to the bottom of the receptacle, when in use and the distal end of the filling ramp 1 will be in contact with the surface 7 or the distal end of the filling ramp 1 will approach the surface 7 or the distal end of the filling ramp 1 will approach the surface 7 such that slight or moderate pressure on the receptacle 2 will cause the distal end to contact the surface 7.

In some embodiments, a spacer can be attached to the bottom surface of the sheet of the filling ramp 1 such that the spacer will contact surface upon which the receptacle 2 and the distal end of the filling ramp 1 is placed and the spacer will raise the opening of the receptacle 2 in relation to the bottom of the receptacle 2 and the central axis of the receptacle will be inclined toward the opening. Such a configuration can provide improved filling of the receptacle and easier shifting of contents placed in the receptacle 2 to the bottom of the receptacle April 2. In addition, such a configuration presents additional advantages concerning the filling of the receptacle 2 with liquid or wet materials in that liquids or liquid released from what materials will be constrained from flowing back out of the receptacle 2.

In use, filling ramp 1 allows for clearance between the surface 7 and an outer wall 9 of the receptacle 2 sufficient to allow a handle 8 of the receptacle to be positioned between the surface and the receptacle, and still have the distal end 16 of filling ramp 1 contact or be made to contact the surface 7 without lifting the bottom 5 of the receptacle 2. This configuration allows the other handle 8 of the receptacle 2 to be used as a handle while using the filling ramp 1 to fill the receptacle 2, such as for moving or repositioning receptacle 2. In addition, embodiments of the filling ramp 1 disclosed herein can be attachable and removable from receptacle 2.

In some embodiments, the distal end 16 can have a thickness that facilitates movement of material from a surface 7 in contact with the distal end onto the filling ramp 1, meaning that the transition from the surface 7 to the filling ramp presents at most a small vertical transition from the surface 7 to the filling ramp 1 and material traversing the transition is not significantly hindered. In some embodiments, the distal end 16 can be tapered or have a square cut. In some embodiments, the thickness of the distal end can be less than 0.3 mm, 0.5 mm, 0.8 mm, 1 mm, 2 mm or 3 mm.

In some embodiments, the distal end 16 can actually contact the surface 7 upon which the receptacle, in a loading position, rests. In some embodiments, the distal end 16 will approach the surface closely, such as where moderate downward force on the rim of the 3 of the receptacle 2 will cause the filling ramp 1 and/or the receptacle 2 to flex or distort sufficiently to cause the distal end 16 to contact the surface 7. In some embodiments, the distal end 16 will approach the surface 7 with a distance between distal end 16 and surface of less than 1 mm, 2 mm, 3 mm, 4 mm, 5 mm, 6 mm, 7 mm, 8 mm, 9 mm, 10 mm, 11, 12 mm 13 mm, 14 mm or 15 mm.

In some embodiments, the distal end 16 has a substantially linear edge. A substantially linear edge would be understood by one of skill in the art as including edges which are linear over the intended useful portion of the edge as well as edges that have only small deviations from the edge being linear, and where the deviations do not affect the functionality of the edge as providing an area where material can be pushed, swept or otherwise moved from a surface to the filling ramp 1.

Materials

The filling ramp 1 can be constructed of any suitable material that provides sufficient stiffness and resilience to allow material to be pushed up the filling ramp into the receptacle 2. In some embodiments, the material used for the filling ramp 1 can be sufficiently resilient and flexible to allow the filling ramp to be distorted, such as by twisting or compressing, in order to install the filling ramp 1 on the receptacle 2. In some embodiments, the resilience of the material allows one size of filling ramp 1 to fit a range of sizes of receptacles, such as where one size can fit trash cans of from 20 to 44 gallons (76 to 167 liters). In some embodiments, the filling ramp can be made from a polypropylene or a polyethylene or another polymeric material such as polycarbonate, ABS, any of the polyacrylates or polymethacrylates. Other materials include metals, such as steel, galvanized steel, brass, tin, zinc and the like. In some embodiments, the material used for the filling ramp 1 can be the same material as used for the receptacle 2.

In some embodiments, the stiffness of the filling ramp 1 or the stiffness of the filling ramp connectors 12 can be related to the stiffness of the receptacle 2 or the rim 3 of the receptacle 2. In some embodiments, materials and the dimensioning of the filling ramp 1 or the filling ramp connectors 12 can be adjusted to modify the stiffness of the filling ramp 1 or connectors 12 in relation to the stiffness of the receptacle 2.

In some embodiments, the distal end of the filling ramp 1 can have sufficient resilience such that when in use, pushing down on the receptacle 2 or the filling ramp 1 will cause the distal end of the filling ramp 1 to conform to the surface the distal end is contacting.

Liner Bags

A further benefit of embodiments of the filling ramp 1 disclosed herein is compatibility with liners or bags being used within receptacle 2, such as a trash bag inside a trashcan. A liner can be placed within the receptacle 2 with the open end of the liner corresponding to the opening of the receptacle and the liner extending out over and folding back over the rim 3 of the receptacle 2. In various embodiments disclosed herein, such as those of FIGS. 1, 2, 3, 4. The connectors 12 could connect to the receptacle 2 and capture or pinch the liner between the filling ramp 1 and the receptacle 3 and/or between the connector 12 and the receptacle 2. In some embodiments, one or more portions of connector 12 can be poked through an opening in the liner that corresponds to an opening in the receptacle 2 that corresponds to connector 12. In some embodiments, the connector 12 can be forced through the liner into the corresponding opening in receptacle 2, forming the hole in the liner or gathering excess liner material as it passes through the opening in receptacle 2. In various embodiments, when the liner is full, the liner can be torn away from the connector 12 or the filling ramp 1 can be removed and the liner removed from receptacle 2.

In the various embodiments, features described in the alternative, for example curved ends and flat surfaces for the interior surface of the sleeve and the exterior surface of the nut can be interchanged within the disclosure where only one of the alternatives is described, except where the context indicates otherwise.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

CONCEPTS

1. A filling ramp for attachment to and filling of a receptacle, the filling ramp comprising:

an attachment end for attachment to a receptacle, the attachment end comprising connectors configured to interface with the rim of the receptacle;

a sheet extending from the attachment end at a proximal end to terminate at a distal end and forming a slide between the distal and proximal ends, the distal end forming a substantially linear edge having a thickness that facilitates movement of material from a surface in contact with the distal end onto the filling ramp, wherein a portion of the filling ramp is configured to extend into the opening of the receptacle a first distance when attached to the receptacle, the distal end is located a second distance away from an outer wall of the receptacle in a direction normal to the wall of the receptacle that is greater the first distance.

2. The filling ramp of concept 1, wherein the attachment end comprises an attachment flange and the filling ramp further comprising a skirt extending from the attachment flange and configured to fit inside the receptacle and configured to cover a portion of the interface between the filling ramp and the receptacle end with the connectors to grasp an upper edge of the receptacle, and the length of the skirt is the first distance.

3. The filling ramp of concept 1, wherein attachment end forms a curve or a circular segment.

4. The filling ramp of concept 3, wherein the sheet further comprises a gradual transition from the substantially linear edge of the distal end and the curve or circular segment of the attachment end.

5. The filling ramp of concept 2, wherein the connectors comprise hooks, the hooks extending from the attachment flange and configured to engage a lower surface of a rim on the receptacle.

6. The filling ramp of concept 5, wherein the hooks are square hooks with a wedge portion extending below the hook.

7. The filling ramp of concept 6, wherein each of the hooks further comprise a retainer extending from the end of the square hook and configured to extend around the rim on the receptacle.

8. The filling ramp of concept 2, wherein the connectors comprise a bracket extending from the attachment flange and a thickened portion extending from the bracket, wherein the bracket is configured for the thickened portion to be slid over a rim of the receptacle and to engage a lower surface of the rim.

9. The filling ramp of concept 1, wherein the brackets comprise pins and the rim of the receptacle comprises receivers and the pins are receivable into the receivers.

10. The filling ramp of concept 1, the brackets comprising tabs with sideways extending locking tabs.

11. The filling ramp of concept 1, wherein the brackets comprise twist lock connectors which connectively communicate with receivers on the rim of the receptacle.

12. The filling ramp of concept 1, further comprising an adapter comprising the corresponding receivers, and the adapter is attachable to the receptacle with fasteners or with a twistlock connection.

13. A receptacle system comprising:

a receptacle comprising one or more handles situated on the outer wall of the receptacle; and the filling ramp of concept 1, wherein the filling ramp is connected to a rim at an opening of the receptacle with the sheet extending upward and radially outward from the rim of the receptacle and one of the one or more handles of the receptacle is located on the outer wall directly below the filling ramp, and the second distance is greater than a length that the one handle extends normal to the outer wall.

14. The receptacle system of concept 13, wherein the filling ramp extends into the receptacle with the proximal edge being displaced radially inside the receptacle.

15. The receptacle system of concept 13, wherein the attachment end comprises an attachment flange and the filling ramp further comprises a skirt extending from the attachment flange and is configured to fit inside the receptacle and configured to cover the interface between the filling ramp and the receptacle and with the brackets to grasp an upper edge of the receptacle.

16. The receptacle system of concept 13, wherein the filling ramp is removable from the receptacle.

17. The receptacle system of concept 13, wherein the filling ramp is attachable and detachable from the receptacle.

18. The receptacle system of concept 13, wherein when the receptacle system is located on a surface and positioned on the receptacle system's side, the bottom and the distal end are in contact with the surface while the one handle is located between the surface and the outer wall of the receptacle.

19. A filling ramp for attachment to and filling of a receptacle, the filling ramp comprising:

an attachment end for attachment to a receptacle, the attachment end comprising connectors configured to interface with the rim of the receptacle;

a sheet extending from the attachment end at a proximal end to terminate at a distal end and forming a slide between the distal and proximal ends, the distal end forming a substantially linear edge having a thickness that facilitates movement of material from a surface in contact with the distal end onto the filling ramp, wherein the distal end is located a distance away from an outer wall of the receptacle in a direction normal to the wall of the receptacle.

20. A receptacle system comprising:

a receptacle comprising one or more handles situated on the outer wall of the receptacle; and the filling ramp of concept 19, wherein the filling ramp is connected to a rim at an opening of the receptacle with the sheet extending upward and radially outward from the rim of the receptacle and one of the one or more handles of the receptacle is located on the outer wall directly below the filling ramp, and the distance the distal end is located away from the outer wall of the receptacle is sufficient to allow one of the one or more handles to pass within a line drawn from the distal end to an edge of the bottom of the receptacle.

The invention claimed is:

1. A filling ramp for attachment to and filling of a receptacle, the filling ramp comprising:

an attachment end for attachment to a receptacle, the attachment end comprising connectors configured to interface with the rim of the receptacle;

a sheet extending from the attachment end at a proximal end to terminate at a distal end and forming a slide between the distal and proximal ends, the distal end forming a substantially linear edge having a thickness that facilitates movement of material from a surface in contact with the distal end onto the filling ramp, wherein a portion of the filling ramp is configured to extend into the opening of the receptacle a first distance when attached to the receptacle, the distal end is located a second distance away from an outer wall of the receptacle in a direction normal to the wall of the receptacle that is greater the first distance.

2. The filling ramp of claim 1, wherein the attachment end comprises an attachment flange and the filling ramp further comprising a skirt extending from the attachment flange and configured to fit inside the receptacle and configured to cover a portion of the interface between the filling ramp and the receptacle end with the connectors to grasp an upper edge of the receptacle, and the length of the skirt is the first distance.

3. The filling ramp of claim 1, wherein attachment end forms a curve or a circular segment.

4. The filling ramp of claim 3, wherein the sheet further comprises a gradual transition from the substantially linear edge of the distal end and the curve or circular segment of the attachment end.

5. The filling ramp of claim 2, wherein the connectors comprise hooks, the hooks extending from the attachment flange and configured to engage a lower surface of a rim on the receptacle.

6. The filling ramp of claim 5, wherein the hooks are square hooks with a wedge portion extending below the hook.

7. The filling ramp of claim 6, wherein each of the hooks further comprise a retainer extending from the end of the square hook and configured to extend around the rim on the receptacle.

8. The filling ramp of claim 2, wherein the connectors comprise a bracket extending from the attachment flange and a thickened portion extending from the bracket, wherein the bracket is configured for the thickened portion to be slid over a rim of the receptacle and to engage a lower surface of the rim.

9. The filling ramp of claim 1, wherein the brackets comprise pins and the rim of the receptacle comprises receivers and the pins are receivable into the receivers.

10. The filling ramp of claim 1, the brackets comprising tabs with sideways extending locking tabs.

11. The filling ramp of claim 1, wherein the brackets comprise twist lock connectors which connectively communicate with receivers on the rim of the receptacle.

12. The filling ramp of claim 1, further comprising an adapter comprising the corresponding receivers, and the adapter is attachable to the receptacle with fasteners or with a twistlock connection.

13. A receptacle system comprising:

a receptacle comprising one or more handles situated on the outer wall of the receptacle; and the filling ramp of claim 1, wherein the filling ramp is connected to a rim at an opening of the receptacle with the sheet extending upward and radially outward from the rim of the receptacle and one of the one or more handles of the receptacle is located on the outer wall directly below the filling ramp, and the second distance is greater than a length that the one handle extends normal to the outer wall.

14. The receptacle system of claim 13, wherein the filling ramp extends into the receptacle with the proximal edge being displaced radially inside the receptacle.

15. The receptacle system of claim 13, wherein the attachment end comprises an attachment flange and the filling ramp further comprises a skirt extending from the attachment flange and is configured to fit inside the receptacle and configured to cover the interface between the filling ramp and the receptacle and with the brackets to grasp an upper edge of the receptacle.

16. The receptacle system of claim 13, wherein the filling ramp is removable from the receptacle.

17. The receptacle system of claim 13, wherein the filling ramp is attachable and detachable from the receptacle.

18. The receptacle system of claim 13, wherein when the receptacle system is located on a surface and positioned on the receptacle system's side, the bottom and the distal end are in contact with the surface while the one handle is located between the surface and the outer wall of the receptacle.

* * * * *